United States Patent [19]

Liburdi

[11] Patent Number: 4,541,174

[45] Date of Patent: Sep. 17, 1985

[54] PROCESS OF MAKING A JACK-TYPE ELECTRICAL CONNECTOR

[75] Inventor: Francesco Liburdi, Endicott, N.Y.

[73] Assignee: Allied Corporation, Morris Township, Morris County, N.J.

[21] Appl. No.: 616,874

[22] Filed: Jun. 4, 1984

[51] Int. Cl.[4] ..... H01R 43/00

[52] U.S. Cl. ..... 29/883; 339/276 SF

[58] Field of Search ..... 29/883, 884; 339/218 M, 339/276 SF, 91 R

[56] References Cited

U.S. PATENT DOCUMENTS

| | | | |
|---|---|---|---|
| 3,444,619 | 5/1969 | Lomerson | 29/884 |
| 3,774,141 | 11/1973 | Condon | 339/276 SF X |
| 4,054,354 | 10/1977 | Unger | 339/276 SF X |
| 4,193,654 | 3/1980 | Hughes et al. | 339/91 R X |
| 4,292,736 | 10/1981 | Hughes et al. | 29/884 |
| 4,337,574 | 7/1982 | Hughes et al. | 29/883 |
| 4,379,609 | 4/1983 | Hardesty | 339/91 R |

*Primary Examiner*—Howard N. Goldberg
*Assistant Examiner*—Carl J. Arbes

[57] ABSTRACT

The invention is a process of simultaneously making a plurality of jack-type electrical connectors characterized by the steps of molding together a plurality of housings (10); stamping and forming a plurality of groups (20) of electrical conductors (21) in the same spaced relationship as the housings (10); molding to each group of electrical conductors (21) a respective plastic member (50); placing the free ends of each group (20) of electrical conductors (21) through the passages (12) in respective housings (10) so that they extend into the housing cavities (13); forming the remaining portion of the electrical conductors (21) into the grooves (11) in respective housings (10); snapping the plastic members (50) into the recesses (18) in respective housings (10). The housings may then be separated for individual use.

1 Claim, 9 Drawing Figures

PROCESS OF MAKING A JACK-TYPE ELECTRICAL CONNECTOR

This invention relates to an electrical connector assembly of the plug and jack type used on telephones.

Plug and jack type electrical connectors are used extensively in the communications field, especially in conjunction with telephones. As a result, plug and jack type electrical connectors are made in very large quantities. Each jack-type connector includes a housing that has a main plug receiving opening and cavity and a plurality of electrical conductors mounted to the housing and extending into the cavity for connection to the respective electrical conductors of a plug inserted into the housing cavity. The cost of making a jack-type connector includes the labor involved with mounting each of the several electrical conductors to each housing and into the housing cavity for eventual electrical connection to the respective conductors of a plug. Accordingly, a large portion of the expense of making a jack-type electrical connector is allocated to the labor of individually wiring each of the jack-type housings with electrical conductors.

DISCLOSURE OF THE INVENTION

This invention is a process of making a jack-type electrical connector that reduces the cost of each jack-type electrical connectors. The process is characterized by the steps of molding several housings connected together by a plastic spacer; stamping and forming a plurality of groups of electrical connectors in the same spaced relationship as the housings; molding to each group of electrical conductors a respective plastic member; placing the free ends of each group of electrical conductors through the passages in respective housings so that they extend into the housing cavities; forming the remaining portion of the electrical conductors into the grooves in respective housings; snapping the plastic members into the recesses in respective housings. The housings may then be separated from their connecting strip for individual use.

One advantage of this invention is that it reduces the cost of making jack-type electrical connectors and provides a method for simultaneously assembling a plurality of jack-type connectors.

DETAILED DESCRIPTION OF THE DRAWINGS

Figure 1:
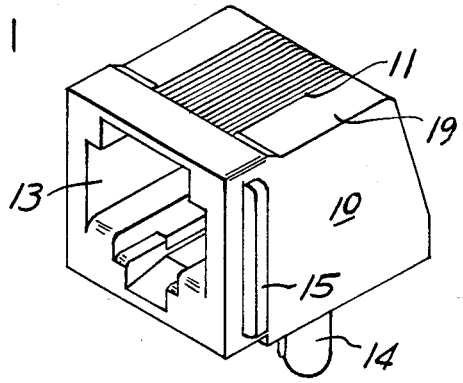
FIG. 1 is a perspective view of a jack-type electrical connector.

Referring now to the drawings, FIG. 1 illustrates a connector housing 10 comprised of a one-piece body of molded plastic. The housing 10 includes a plug receiving opening and cavity 13, a top surface 19, a plurality of grooves 11 extending around a portion of the outside surface of the housing; pins 14 at the bottom of the housing 10 for mounting the housing 10; and side tabs 15.

Figure 2:
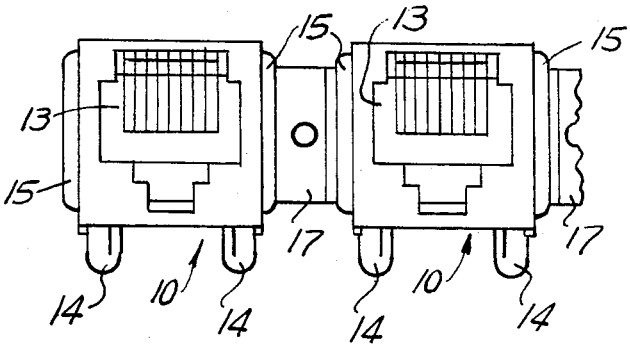
FIG. 2 is a front view of a plurality of jack-type electrical connector housings molded together.

FIG. 2 is a front view of a plurality of molded housings all integrally connected together in a single strip by connecting segment portions 17.

Figure 3:
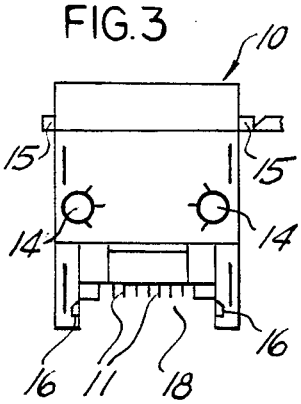
FIGS. 3 and 4 are bottom and top views of the connector housing shown in FIGS. 1 and 2.

FIG. 3 is a bottom view of the housing shown in FIGS. 1 and 2 and illustrates a pair of notches 16 in a recess 18 located in the bottom surface of the housing 10.

Figure 4:
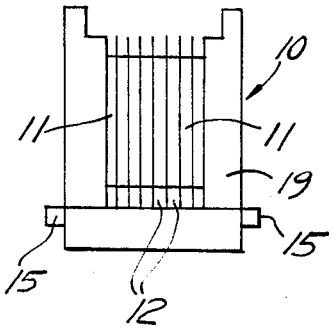

FIG. 4 is a top view of the housing 10 shown in FIGS. 1 and 2 and illustrates the passages 12 through the top surface 19 between the grooves 11 and the housing cavity 13.

Figure 5:
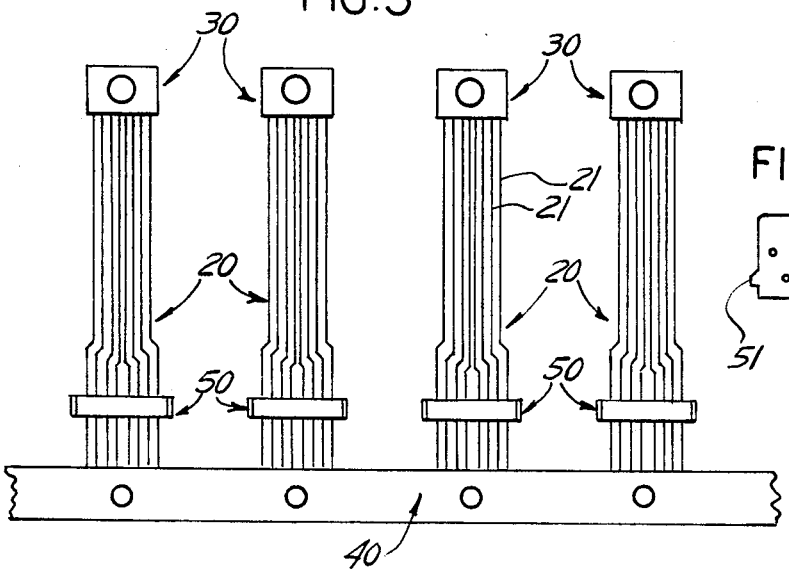
FIG. 5 illustrates groups of electrical conductors with a plastic member molded to each group of conductors.

FIG. 5 illustrates groups 20 of electrical conductors 21 stamped and formed from a sheet of metal in a predetermined relationship. To maintain this predetermined relationship, a first plurality of metal end segments 30 are at one end of a respective group 20 of conductors 21 and a second metal end segment 40 is at the other end of the conductors. A plurality of plastic members 50 are shown molded to respective groups 20 of conductors 21 at a predetermined location between the first and second metal end segments 30, 40. Each of the groups 20 of electrical conductors 21 are arranged in the same spaced relationship as the passages 12 in respective housings 10 shown in FIGS. 2 and 4.

Figure 6:
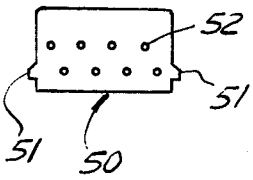
FIG. 6 illustrates a bottom view of one of the plastic members shown in FIG. 5.

FIG. 6 is a plan view of a the plastic member 50 illustrating a pair of tabs 51 adapted to snap into the notches 16 of the recess in a respective connector housing 10 shown in FIG. 3. Each of the plastic members 50 includes a plurality of openings 52 arranged in the same predetermined relationship as the stamped and formed electrical conductors 21 shown in FIG. 5.

Figure 7:
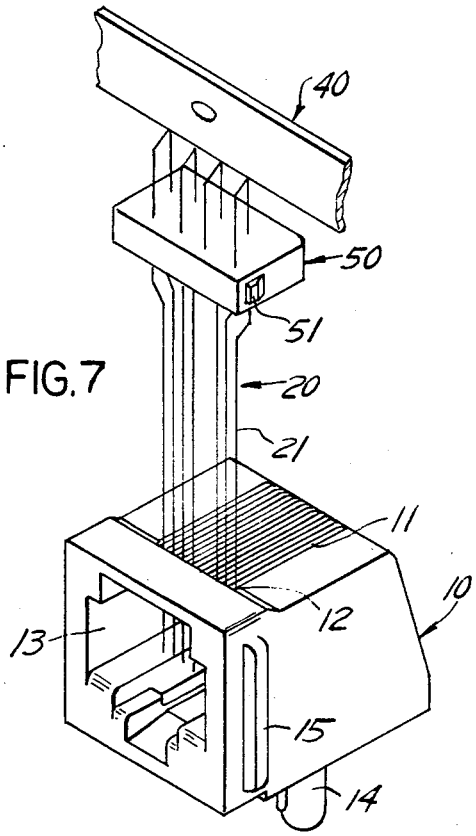
FIGS. 7, 8 and 9 illustrate some of the steps in the process of assembling a jack-type electrical connector that incorporates the principles of this invention.

FIG. 7 illustrates one end of a group 20 of electrical conductors 21 extending through the passages 12 and into the cavity 13 of the housing 10.

Figure 8:
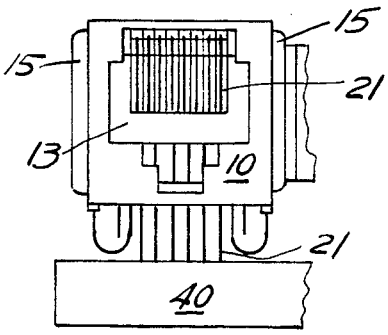

FIG. 8 illustrates a front view of the housing 10 with the remaining portion of the electrical conductors 21 formed into the grooves 11 in the outside surface of the connector housing 10.

Figure 9:
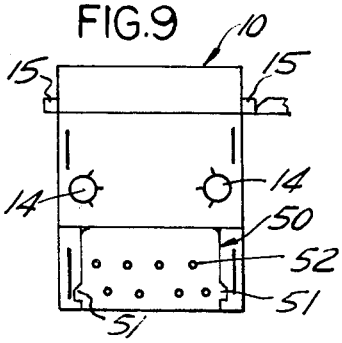

FIG. 9 illustrates the plastic member 50 snapped into the recess in the housing 10 after the conductors 21 are formed into the grooves 11.

A process of making a jack-type electrical connector in accordance with the principles of the invention is as follows.

First, a plurality of housings are molded together in the shape and arrangement shown in FIGS. 1 through 4.

Secondly, electrical conductors 21 are stamped and formed into groups 20 and plastic members 50 are molded to them as shown in FIGS. 5 and 6.

Next, the first metal end segments 30 at one end of each group 20 of electrical conductors 21 are removed and the free ends of each group 20 of the electrical conductors 21 are placed through the passages 12 in the top of the housing and into cavities 13 of respective housings 10 as shown in FIG. 7.

The electrical conductors 21 of each group are then formed into the grooves 11 in respective housings 10 and each of the pairs of tabs 51 of each plastic member 50 is snapped into the pair of notches 16 in a recess in the bottom surface of respective housings 10. (FIGS. 8 and 9).

Next, the second metal end segment 40 is removed from each group 20 of conductors 21 and the housings 10 are separated from each other for independent use.

From the foregoing, it can be seen that a plurality of connector housings 10 may be assembled at one time permitting machine assembly of a multiplicity of jack-type electrical connectors.

Having described the invention what is claimed is:

1. A process of making a jack-type electrical connector comprising the steps of:

molding a plurality of plastic housings connected together a predetermined distance by plastic connecting segments, each housing having: a main plug receiving opening and cavity; a recess in one outer surface of each housing adjacent said opening that includes a pair of notches, each notch located opposite the other notch; a plurality of passages between the cavity and another surface of the housing opposite said surface with the recess; and a plurality of grooves on the outside surface of the housing arranged in a predetermined manner between said passages and said recess;

stamping from a single sheet of metal a plurality of electrical conductors arranged into a plurality of groups of electrical conductors in the same spaced relationship as the passages in respective housings; said conductors including a plurality of first metal end segments and a second metal end segment, each of said first metal end segments located at one end of a respective group of electrical conductors, said second metal end segment located at the other end of said conductors to connect each group of conductors together;

forming one end portion of each group of conductors adjacent said second metal end segment into a predetermined configuration;

molding to said portion of each group of conductors formed into the predetermined configuration a respective plastic member having a pair of tabs adapted to snap into the pair of notches in the recess of a respective housing;

removing the plurality of first metal end segments from said plurality of electrical conductors to provide a plurality of free ends;

placing the free ends of each group of electrical conductors into the passages in respective housings;

forming each group of electrical conductors into the grooves in respective housings;

placing the tabs of each plastic member into the notches of a respective housing recess to retain each electrical conductor in a groove between the passages and the plastic member mounted in the housing recess; and removing the second metal segment from said groups of electrical conductors.

* * * * *